US005699813A

United States Patent [19]

Carroll

[11] Patent Number: 5,699,813

[45] Date of Patent: Dec. 23, 1997

[54] ARTIFICIAL FINGERNAIL WITH INLAY

[76] Inventor: George H. Carroll, 853 Via Alondra, Camarillo, Calif. 93012

[21] Appl. No.: 694,511

[22] Filed: Aug. 9, 1996

[51] Int. Cl.[6] ..... A45D 29/00

[52] U.S. Cl. ..... 132/73

[58] Field of Search ..... 132/73, 285, 200; 428/67, 77, 78, 79; D28/56, 62; 63/2, 20, 15.8, 15

[56] References Cited

U.S. PATENT DOCUMENTS

| | | | |
|---|---|---|---|
| 1,942,332 | 1/1934 | Hamberg | 63/2 |
| 2,013,290 | 9/1935 | Rohrbach | 63/2 |
| 2,162,155 | 6/1939 | Calvin | 132/73 |
| 2,199,207 | 4/1940 | Nolan | D28/56 |
| 2,633,139 | 3/1953 | Petty . | |
| 2,746,460 | 8/1956 | Jellinek . | |
| 4,042,090 | 8/1977 | Hasebe . | |
| 4,500,218 | 2/1985 | Nishikawa . | |
| 4,656,078 | 4/1987 | Goto et al. . | |
| 4,860,774 | 8/1989 | Becker . | |
| 4,898,192 | 2/1990 | Cohen . | |
| 4,920,991 | 5/1990 | Shibahashi et al. . | |
| 4,974,610 | 12/1990 | Orsini | 132/73 |

FOREIGN PATENT DOCUMENTS

| | | | |
|---|---|---|---|
| 1037217 | 5/1951 | France | 63/2 |
| 12855 | of 1915 | United Kingdom | 63/15 |

*Primary Examiner*—Todd E. Manahan
*Assistant Examiner*—E. Robert
*Attorney, Agent, or Firm*—Dennis H. Lambert

[57] ABSTRACT

An artificial fingernail is molded with an inlay on its top surface. In a preferred embodiment, the fingernail is colored to simulate the style of a French fingernail, with lighter colored cuticle and tip end portions and a darker color central portion. According to the invention, a fingernail-shaped base member is molded of a first, lighter color, preferably translucent, and an inlay of a second, darker color, preferably opaque, is molded into a top surface of the base member to produce areas of different color resulting in the desired fingernail style. Secure attachment of the inlay to the base member is insured by provision of a mechanical lock between the base member and the inlay.

14 Claims, 2 Drawing Sheets

ARTIFICIAL FINGERNAIL WITH INLAY

BACKGROUND OF THE INVENTION

1. Field of the Invention

This invention relates generally to artificial fingernails, and more particularly, to an artificial fingernail that has an inlay molded in a top surface to produce a desired cosmetic effect, e.g., one having lighter color cuticle and tip end portions and a darker central portion, commonly known as a French fingernail style.

2. Description of the Prior Art

Fingernails are frequently cosmetically enhanced by applying artificial fingernails over the natural nail. Artificial fingernails are typically thin, molded plastic members that are produced in a variety of sizes to fit the fingernails of different persons, and are manufactured in a shape generally corresponding to the shape of a natural nail.

Artificial fingernails are usually produced in a translucent plastic material that has a color close to the color of a natural nail, if the natural nail were removed from the finger. After application, fingernail polish or other material is applied to the artificial fingernail to produce brightly colored or decorative nails, just as may be applied to a natural nail. One popular style is the so-called French fingernail, which has lighter, natural color cuticle (luna) and tip end portions with a darker colored central portion. Considerable skill and time is required to craft the French fingernail style, which may be produced by the application of a darker colored nail polish to a central portion of a natural or an artificial fingernail.

Other cosmetic and decorative designs can be applied to natural or artificial fingernails, either by applying adhesive appliques to the fingernail or by painting specific designs on the nail. However, such methods require considerable care and skill in applying the decorative designs.

Accordingly, there is need for an artificial fingernail that is manufactured with a desired cosmetic design so that virtually anyone can obtain a desired cosmetic fingernail without the need for exercising the degree of care and skill that is required in utilizing conventional methods and techniques.

SUMMARY OF THE INVENTION

An object of the invention is, therefore, to provide an artificial fingernail that is manufactured with a desired cosmetic design already incorporated in it.

A more specific object of the invention is to provide an artificial fingernail having an inlay in its top surface to produce a desired cosmetic effect.

In accordance with the invention, secure attachment of the inlay to the artificial fingernail is insured by the provision of a mechanical lock between the inlay and base member forming the nail. The base member is molded with a desired shape, which may correspond to the shape of a natural nail, with a cuticle end and a base end. A recessed area is molded into the top surface of the base member between the cuticle end and the base end, and the insert or inlay is molded into the recessed area. In a specific example of the invention, the base member may be molded of a translucent material, and the inlay may be molded of an opaque material, with its opposite ends curved to simulate the curvature of a natural nail adjacent the cuticle and the tip, thereby producing a style or design that is commonly referred to as a French fingernail style. It should be understood that other styles and designs may be made which incorporate the invention.

In a specific embodiment of the invention, opposite ends of the recessed area in the base member are undercut, and the inlay extends into these undercut areas and wraps around the opposite side edges of the base member to mechanically lock the inlay to the base member, thereby insuring secure attachment of the inlay to the base member.

The artificial fingernail produced in accordance with the specific invention illustrated and described herein may thus be used when a French fingernail style is desired, without the need for application of different colors to the nail in order to produce the French fingernail style. The invention may also be used to produce other decorative designs or cosmetic enhancements by utilization of the same principle concerning the application of the inlay to a base member.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENT

Figure 1:
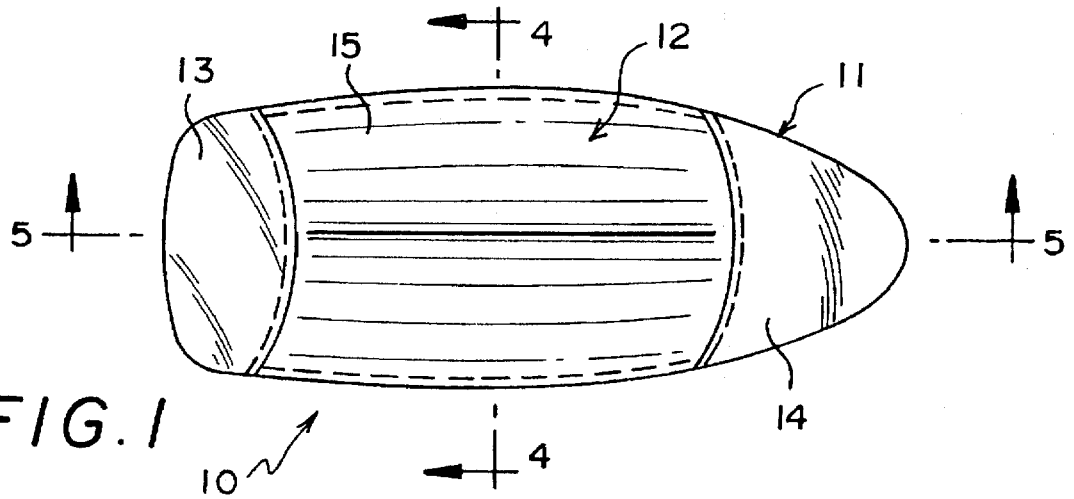
FIG. 1 is a top plan view of an artificial fingernail produced in accordance with the invention.
Figure 2:
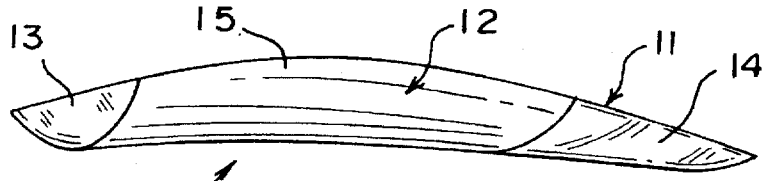
FIG. 2 is a side view in elevation thereof.
Figure 3:
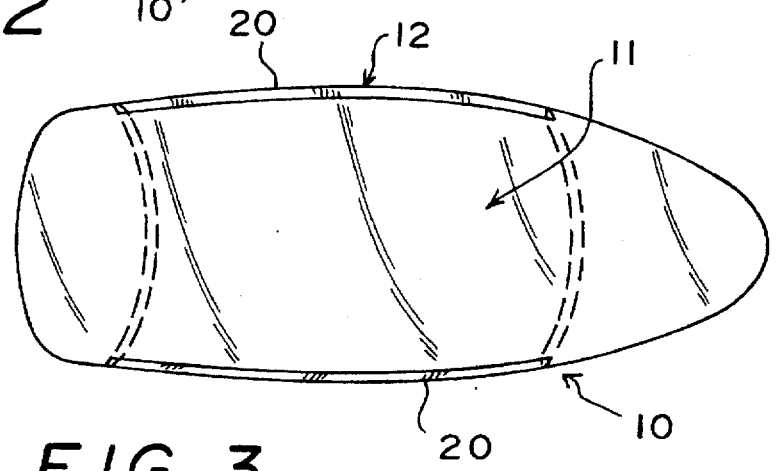
FIG. 3 is a bottom plan view thereof.
Figure 4:
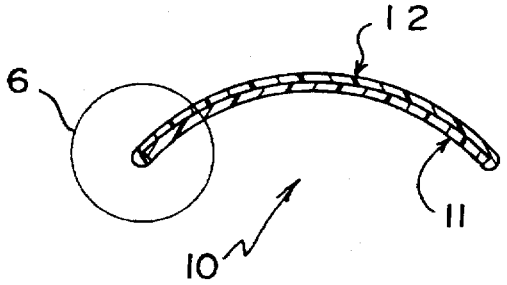
FIG. 4 is a transverse sectional view taken along line 4—4 in FIG. 1.

Referring more particularly to the drawings, an artificial fingernail in accordance with the invention is indicated generally at 10 in the drawings. This fingernail comprises a base member 11 having the same general overall shape or configuration as a natural fingernail, and an inlay 12 molded into a top surface of the base member to produce a desired cosmetic effect, e.g., a French fingernail style in the particular embodiment shown. It should be understood, however, that the base member may have other shapes, and different styles or designs may be produced using the invention.

The base member 11 is first molded of a translucent material simulating the natural color of a natural fingernail, and the inlay is molded of an opaque material to produce a darker central portion of the artificial fingernail. The artificial fingernail thus produced has lighter colored cuticle and tip end portions 13 and 14, respectively, and a darker colored central portion 15, simulating the appearance of a natural nail done in the French fingernail style.

The base member and inlay may be made of the same material or of different materials, and may comprise those materials commonly employed in the manufacture of artificial fingernails, i.e., ABS plastic, nylon, or vinyl acetate. Other materials, as appropriate, could also be utilized if desired. Moreover, the base member may have a thickness of from about 0.015 to about 0.025 inch, and the inlay may have a thickness of from about 0.003 to about 0.004 inch. Depending upon the particular design or style that is desired, these dimensions could vary, as appropriate.

Figure 5:
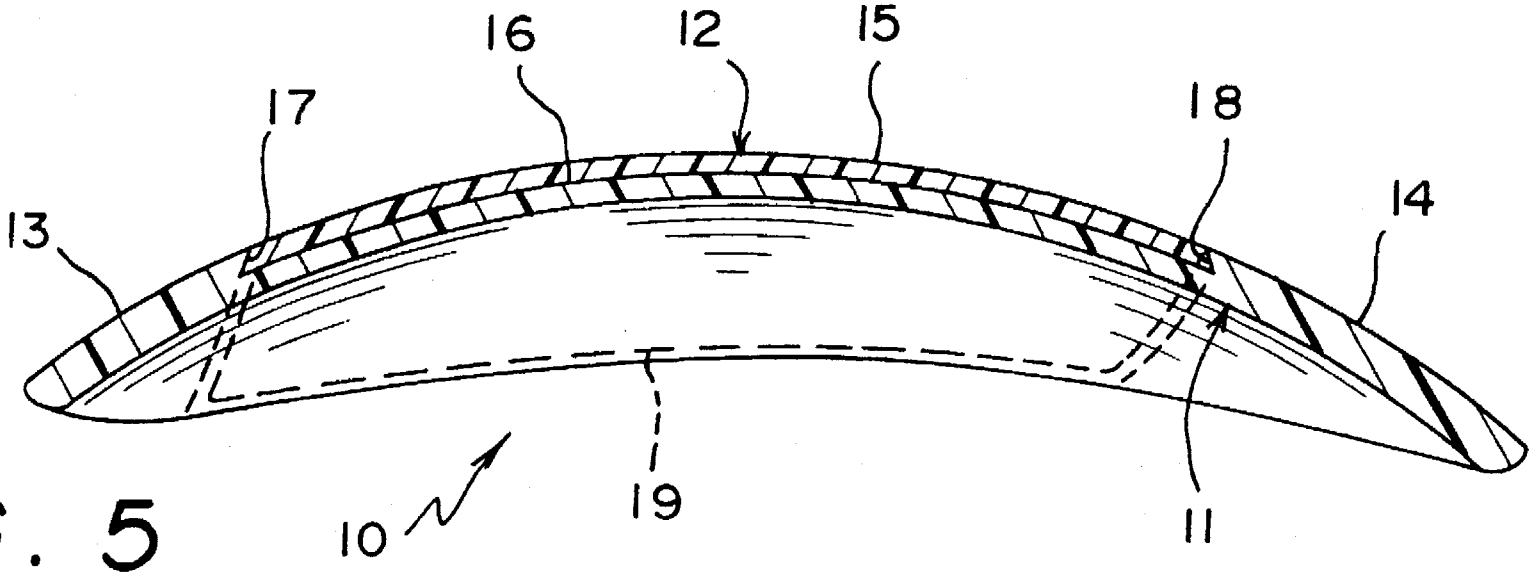
FIG. 5 is an enlarged longitudinal sectional view taken along line 5—5 in FIG. 1.
Figure 6:
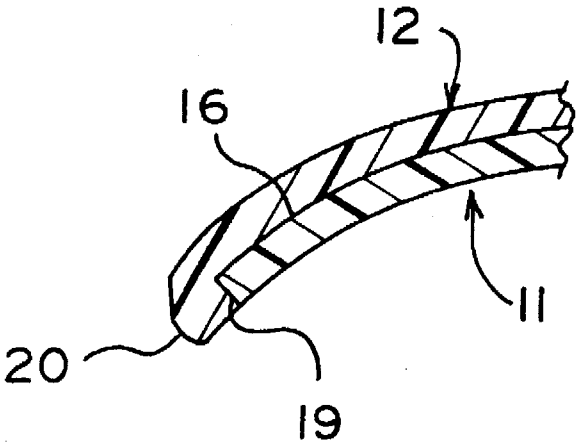
FIG. 6 is a greatly enlarged fragmentary sectional view taken in the circled area of FIG. 4.

As seen best in FIGS. 5 and 6, the central portion of the base member 11 in which the inlay 12 is applied is recessed at 16. This recessed area 16 is undercut at its opposite ends at 17 and 18 and extends completely across the width of the base member to produce slightly narrowed and downwardly angled side edge surfaces or shoulders 19. Thus, when the inlay 12 is molded in the recess, opposite end portions thereof extend into the undercut areas 17 and 18 and opposite side edges 20 thereof wrap around the narrowed side edges 19 of the base member to provided a mechanical lock between the inlay and base member.

The artificial fingernail of the invention could be molded on a rotary mold, or inserts could be used to produce the recessed area for subsequent molding of the inlay, or two different molds could be utilized, with molding of the base member and the inlay being accomplished in two steps. Injection blow molding could also be used, for more precise control of the dimensions.

While particular embodiments of the invention have been illustrated and described in detail herein, it should be understood that various changes and modifications may be made to the invention without departing from the spirit and intent of the invention as defined by the scope of the appended claims.

What is claimed is:

1. An artificial fingernail having an inlay in a top surface thereof, comprising:

a base member having a fingernail shape with a top surface;

a recessed area in the top surface; and an inlay in the recessed area in the top surface of the base member to produce a desired cosmetic effect.

2. An artificial fingernail as claimed in claim 1, wherein:

the inlay is molded to the base member.

3. An artificial fingernail as claimed in claim 2, wherein:

the base member and inlay are of different colors.

4. An artificial fingernail as claimed in claim 3, wherein:

the recessed area extends completely across the width of the base member, producing narrowed and angularly downwardly inclined opposite side edges on the base member; and the inlay wraps around the side edges of the base member to mechanically lock the inlay to the base member.

5. An artificial fingernail as claimed in claim 3, wherein:

the recessed area is undercut at its ends, and the inlay extends into the undercut areas to mechanically lock the inlay to the base member.

6. An artificial fingernail as claimed in claim 5, wherein:

the recessed area extends completely across the width of the base member, producing narrowed and angularly downwardly inclined opposite side edges on the base member; and the inlay wraps around the side edges of the base member to mechanically lock the inlay to the base member.

7. An artificial fingernail as claimed in claim 1, wherein:

the base member and inlay are of different colors.

8. An artificial fingernail as claimed in claim 7, wherein:

the base member has a tip end, a cuticle end and a central portion extending between the tip end and the cuticle end; and the inlay extends between the cuticle end and tip end of the base member and completely across the width.

9. An artificial fingernail as claimed in claim 8, wherein:

the base member is lighter in color than the inlay and is translucent to simulate a natural fingernail.

10. An artificial fingernail as claimed in claim 9, wherein:

the artificial fingernail simulates a French fingernail style.

11. An artificial fingernail as claimed in claim 9, wherein:

the inlay is molded to the base member.

12. An artificial fingernail as claimed in claim 11, wherein:

the recessed area is undercut at its ends, and the inlay extends into the undercut areas to mechanically lock the inlay to the base member.

13. An artificial fingernail as claimed in claim 12, wherein:

the recessed area extends completely across the width of the base member, producing narrowed and angularly downwardly inclined opposite side edges on the base member; and the inlay wraps around the side edges of the base member to mechanically lock the inlay to the base member.

14. An artificial fingernail as claimed in claim 1, wherein:

the recessed area extends across a central portion of the artificial fingernail, leaving a crescent shaped tip end and a crescent shaped cuticle end; and the cuticle end is translucent, with a color like the natural color of a natural finger nail, and the inlay is opaque, with a color like the central portion of a natural fingernail, whereby the artificial fingernail simulates a French fingernail style.

* * * * *